US005533225A

United States Patent [19]

Ellis

[11] Patent Number: 5,533,225

[45] Date of Patent: Jul. 9, 1996

[54] CLUB TUB - GOLF CLUB WASHER

[76] Inventor: Howard F. Ellis, 505 S. Fisk St., D14, Green Bay, Wis. 54303

[21] Appl. No.: 509,053

[22] Filed: Jul. 31, 1995

[51] Int. Cl.[6] ..... A63B 57/00; A63B 47/04; A46B 11/00

[52] U.S. Cl. ..... 15/104.92; 15/160; 401/122; 473/405

[58] Field of Search ..... 15/104.92, 106, 15/112, 160, 161, 184, 88.1, 21.1, 21.2; 401/121, 122, 196, 207; 273/32 B, 162 F

[56] References Cited

U.S. PATENT DOCUMENTS

| | | | |
|---|---|---|---|
| 1,569,939 | 1/1926 | Sperling | 15/161 |
| 3,748,676 | 7/1973 | Warren et al. | 15/104.92 |
| 3,872,534 | 3/1975 | Hoag | 15/88.1 |
| 4,069,536 | 1/1978 | Hartz et al. | 15/104.92 |
| 4,091,489 | 5/1978 | Nimetz | 15/104.92 |
| 4,380,839 | 4/1983 | Caradonna | 15/104.92 |
| 4,734,952 | 4/1988 | Parchment et al. | 15/104.92 |
| 4,872,235 | 10/1989 | Nielsen | 15/104.92 |
| 4,965,906 | 10/1990 | Mauro | 15/104.92 |
| 5,081,735 | 1/1992 | Wyatt et al. | 15/104.92 |
| 5,404,610 | 4/1995 | Coyer, Sr. et al. | 15/104.92 |

FOREIGN PATENT DOCUMENTS

| | | | |
|---|---|---|---|
| 63114 | 7/1892 | Germany | 15/161 |
| 237297 | 10/1960 | Netherlands | 15/104.92 |

*Primary Examiner*—Gary K. Graham

[57] ABSTRACT

An improved heavy-duty soft plastic golf club washer having the design of an old fashioned bath tub with a protected opening at the sloped front end (16) large enough to accommodate all sizes of golf club heads. Stabilized inside tub are three identical soft plastic brushes (12) (14) each with two slotted openings (34) in their base to allow passage of sediment into sump (36). The brushes are stabilized inside tub (10) by means of brush locks middle (38) as viewed in sectional FIG. 7, and brush locks rear (40) as viewed in sectional FIG. 8, and also by the bottom horizontal brush base. A removable lid (11) with front opening (17) and an open groove (18) to allow movement of golf club shafts. Tub has two rear support flanges (24) designed to fit a standard 4"×4" post, over which the squared opening at rear of lid (11) also fits to cover tub. A rectangular lock plate (26) fits over rear of lid (11) and locks lid to post with two bolts (28) and two spring type cotter pins (30). The lid (11) locks with tub (10) by means of interlocking lips (20) and interlocking lips on tub (22). Each side of tub has a drain opening hole (42) to maintain correct water level.

5 Claims, 2 Drawing Sheets

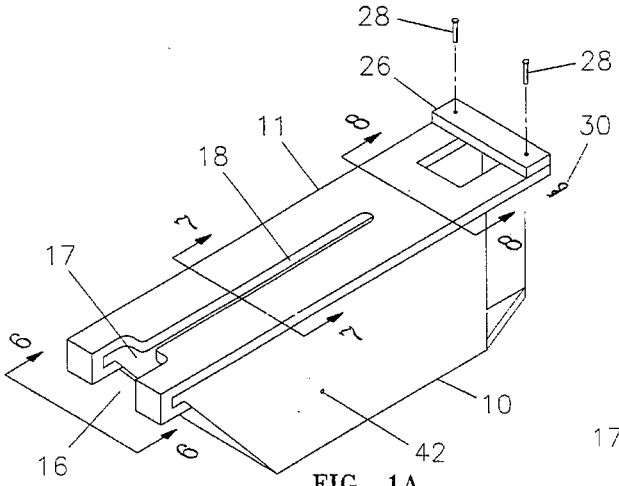
FIG. 1A
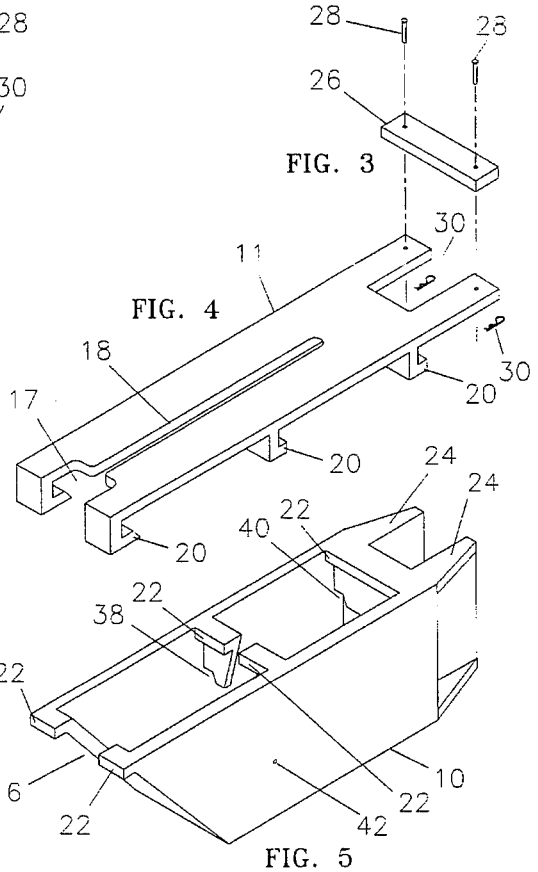
FIG. 3
FIG. 4
FIG. 5
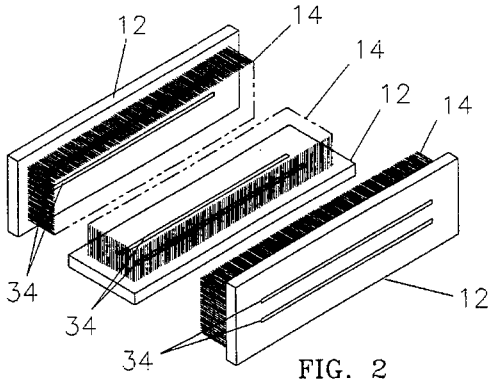
FIG. 2
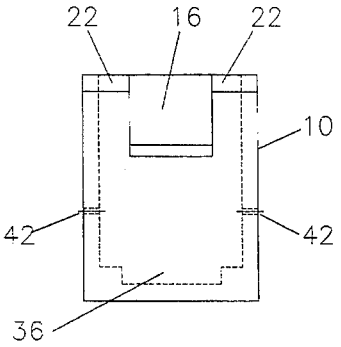
DETAIL ---6-6---
FIG. 6
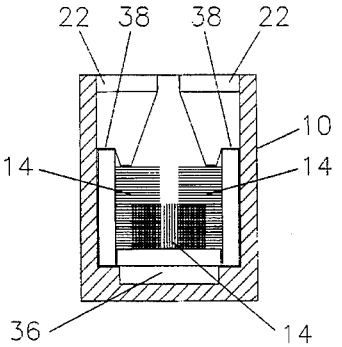
DETAIL ---7-7---
FIG. 7
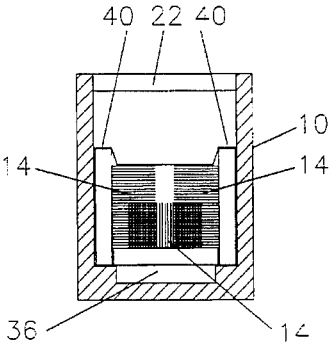
DETAIL ---8-8---
FIG. 8

CLUB TUB - GOLF CLUB WASHER

BACKGROUND-FIELD OF INVENTION

This invention relates to golf club washers provided by golf course owners for convenience of golfers, and located at various locations throughout a golf course.

BACKGROUND-DESCRIPTION OF PRIOR ART

Most golf courses provide golf ball washers on a stand at each tee-off location. Sometimes, but very rarely, these ball wash stands include at the base a thin plastic club washer limited to iron size clubs only. Much more rare are club washers for "wood" type clubs such as drivers. The one "wood" type club washer I used was metal, had a handle and moving brushes inside a container. Constant use by the public caused this type of club washer, with moving parts, to have extreme maintenance and wear problems. Thus, there is limited acceptance by golf course owners. I have seen only one such larger "wood" type club washer in over 30 years of play on many different courses throughout the world. Owners and ground maintenance managers dislike items causing exceptional out-of-routine care and repair, thus the reason for their rarity. Club washers now in use have their entrance opening on top with no space for an ad. This requires owners to purchase an expensive item that could be donated if a space for a sponser or company logo was provided on top and visible to golfers. Golfers would appreciate a golf club washer that accommodates all clubs in their bag, and is located on each nine hole segment. One example of location would be at busy "par 3" holes where traffic gets congested. Waiting becomes more bearable when golfers could be occupied with convenient club washers and performing the necessary duties of the game.

OBJECTS AND ADVANTAGES

The objects and advantages of my "Club Tub" Golf Club Washer are as follows:

a) Provide a convenience for all golfers, during play, to efficiently clean their golf clubs.

b) Provide a club washer with no moving parts to repair by golf course maintenance crew.

c) Provide a club washer that accommodates all golf clubs in the bag, not just iron size only.

d) Provide a club washer so constructed that minimal care is required by grounds keepers during ordinary weekly chores with quick disconnect from post, and quick simple lid removal from tub.

e) Provide a club washer with locked lid and locked post connection avoiding theft or inquisitive meddling by public.

f) Provide a club washer with minimal top opening preventing inside dilution from rain and blowing debris.

g) Provide a club washer with a minimum number of parts to assemble.

h) Provide a club washer with identical brushes to eliminate replacement errors.

i) Provide a club washer with drain opening holes to guarantee correct level of liquid inside tub.

j) Provide a club washer made of soft plastic material preventing club head or shaft damage while using.

k) Provide a club washer that can be installed anywhere on a golf course where there is a 4"×4" post.

l) Provide a golf club washer that can be used by caddies at end of round where clubs are cleaned and stored for members.

m) Provide a club washer that is simple and easy for golfers to operate by moving their golf club heads over brushes inside tub.

n) Provide a club washer that could be used at golf driving ranges after practice because "Club Tub" sits flush on ground or concrete, and 4"×4" post is not necessary for cleaning operation.

o) Provide a club washer with sufficient space on top lid for a sponser's name, ad, or logo to be seen by players, thus providing inducement for businesses to donate the club cleaner for the advertising benefits.

BRIEF DESCRIPTION OF THE DRAWING FIGURES

FIG. 1A shows the "Club Tub" assembled and locked, same as FIG. 1.

FIG. 2 shows the three identical brushes used inside tub with two slotted openings in bases.

FIG. 3 shows the lock plate that fits over rear of lid, with bolts and spring cotter pins.

FIG. 4 shows the top lid with interlocking lips, front lid opening, lid groove, and rear squared opening to fit post.

FIG. 5 shows the tub with interlocking lips, front club opening, brush locks middle and rear inside tub, rear support flange, and drain opening hole.

FIG. 6 is front sectional view of tub corresponding with 6—6 in FIG. 1A showing front club opening, sump, drain opening holes, and interlocking lips.

FIG. 7 is middle sectional view of tub corresponding with 7—7 in FIG. 1A showing brushes mounted inside tub, middle brush locks, sump, and middle interlocking lips.

FIG. 8 is rear sectional view of tub corresponding with 8—8 in FIG. 1A showing brushes mounted inside tub, rear brush locks, sump, and rear interlocking lips.

Reference Numerals in Drawings

Figure 1:
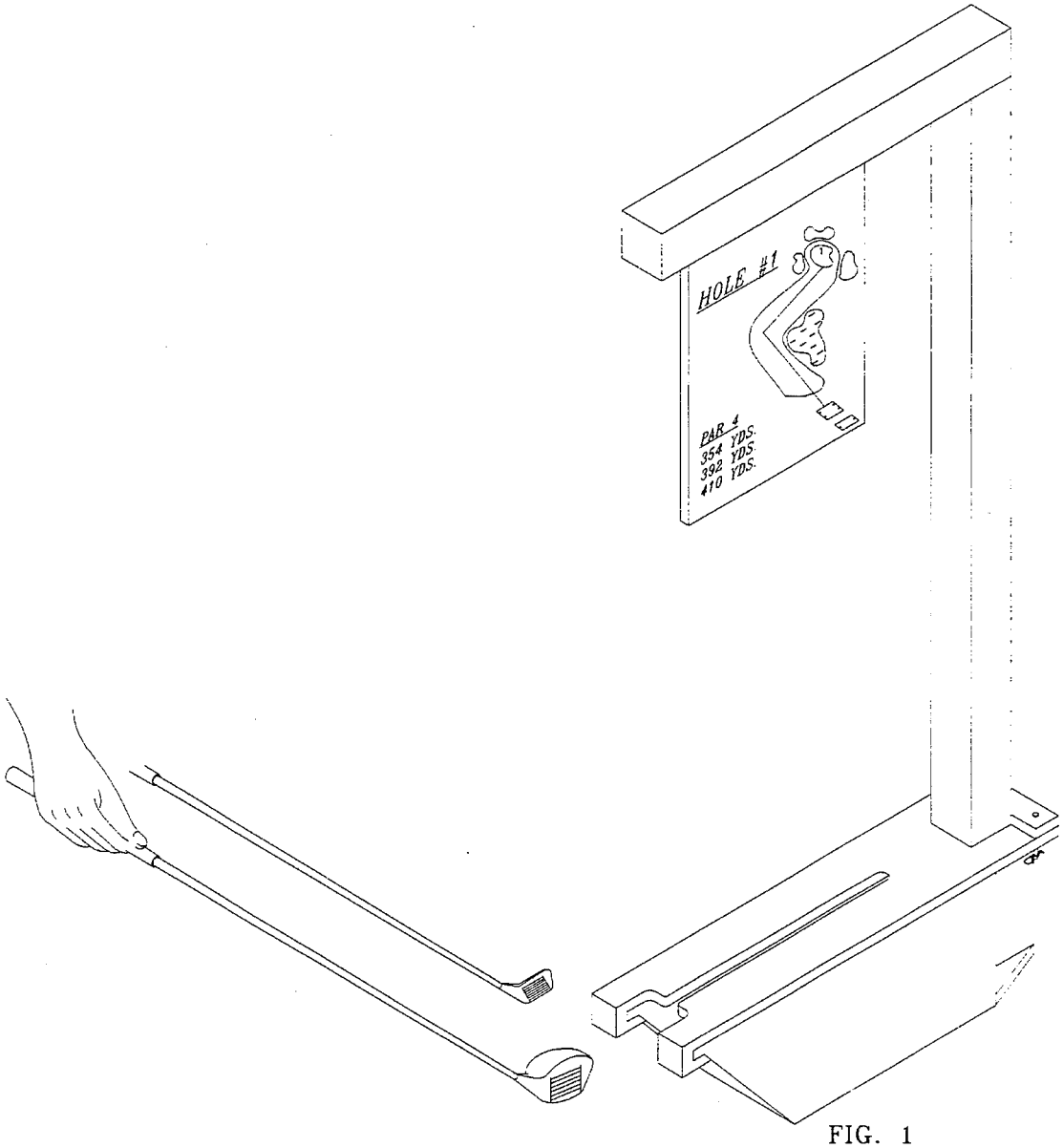
FIG. 1 shows the "Club Tub" assembled, locked, and mounted to a post, with players inserting golf clubs, as it would be seen and used on a golf course.

| | |
|---|---|
| 10 tub | 24 rear support flange |
| 11 tub lid | 26 lock plate |
| 12 brush base | 28 bolts |
| 14 brush bristles | 30 spring cotter pins |
| 16 front tub opening | 34 slotted opening in brush base |
| 17 front lid opening | 36 sump |
| 18 lid groove | 38 brush locks middle |
| 20 interlocking lips on lid | 40 brush locks rear |
| 22 interlocking lips on tub | 42 drain opeing holes |

DESCRIPTION OF THE PREFERRED EMBODIMENT

FIG. 1 is a picture of how my invention would look on any hole of a golf course attached and locked to a square 4"×4" post, and used by golfers to clean any of their golf clubs. This picture shows the top visible advertising space available to doners. My invention can be located anywhere, not confined to a hole description sign as shown.

FIG. 1A is a duplicate of the tub in FIG. 1 showing the sectional view locations 6—6, 7—7 and 8—8 corresponding to FIGS. 6, 7, & 8.

The brushes in FIG. 2 are unique and specially made to accommodate the "Club Tub". The bases 12 are soft plastic to eliminate club head damage, and they have two slotted openings 34 to allow sediment to float through into sump 36 in tub bottom. The bristles 14 are soft plastic to eliminate club head damage. Bristles 14 are specially placed on bases 12 to allow space on both sides for stabilizing the brushes inside the tub. The lower horizontal brush base 12 secures the side brushes at bottom, and the brush locks middle 38 together with brush locks rear 40 secure the side brushes at the top. The brushes in FIG. 2 have identical construction, eliminating ordering and installation errors.

The lock plate 26 in FIG. 3 is vital because it prevents theft and curiosity meddling by the public, and at the same time allows maintenance crew to quickly disconnect lid and tub for cleaning. When the lock plate 26 is in place, the lid 11 cannot slide and remains locked to tub 10 and post. Removal of lock plate 26 by quick disconnect of cotter pins 30 and bolts 28 will allow the lid 11 to slide forward and release from interlocking lips 20 & 22, and be removed from tub. With lock plate removed, tub can slide from post easily, allowing maintenance crew to work efficiently. The front lid opening 17 in FIG. 4 combined with tub opening 16 allows all sizes of golf club heads to be inserted for cleaning. The lid groove 18 allows all sizes of shafts to move fore and aft in cleaning action. Player's club heads can be rotated by hand allow-all sides of head to move against brushes for complete cleaning. The interlocking lips on lid 20 connect with interlocking lips on tub 22 preventing removal. Quick disconnect of lock plate 26 allows forward movement of lid 11 for removal. All materials used in tub, lid, and brushes are soft plastic to eliminate shaft or club head damage.

The "Club Tub" 10 resembles an old fashioned bath tub in FIG. 5. The tub includes a front wall, spaced side walls, a bottom wall and an open top. The front tub opening 16 in the front wall allows both woods and iron type golf clubs to be inserted for cleaning. The opening 16 is on a sloped front side to prevent debris and elements entering tub. The interlocking lips 22 are located at front, middle, and rear of tub, and they interlock with lips 20 on lid. Inside tub are the middle brush locks 38 and the rear brush locks 40. These locks hold the two side brushes mounted inside tub as shown in FIGS. 7 & 8. Rear support flanges 24 define a U-shaped channel fit three sides of any 4"×4" post used anywhere on a golf course, This allows flexibility for the "Club Tub" to be installed wherever convenient. This rear support flange 24 mounted to a 4"×4" post gives stability to the tub preventing side motion.

FIGS. 6, 7 & 8 are sectional views of the front, middle, and rear parts of the tub, and they show the various parts mentioned above. The brush assembly inside tub is unique in that the bottom horizontal brush overlaps the sides of sump 36. The bottom brush also secures the side brushes at the bottom. The brush locks middle 38 and brush locks rear 40 secure the side brushes at the top. The sump 36 holds the sediment caused by cleaning action, keeping the brush bristles 14 from damaging golf club heads. When sump 36 is full, then maintenance crew is aware to empty and clean inside the tub. The sump 36 collection time allows a reasonable interval between maintenance chores.

Operation—FIGS. 1 to 8

Regarding the user of my invention, golfers can clean all clubs in their bag as shown in FIG. 1. By using arm and hand motion rubbing club heads over the brushes inside tub, the operation is simple and obvious to everyone.

Regarding the golf course maintenance crew, they can work with my invention quickly and easily in their routine chores. Simple removal of spring cotter pins 30 and bolts 28 from lock plate 26 allows tub lid 11 to slide forward, unlocking it from tub 10. With lid removed, inside cleaning, brush removal or replacement, or any other work can be accomplished. Tub 10 slides away from 4"×4" post to allow dumping of sump 36, or to move tub to another location.

Summary, Ramifications, and Scope

My invention is adaptable for all golf courses around the world. It can also be used at the caddy shack where clubs of members are sometimes cleaned and stored. The "Club Tub" can be used without a 4"×4" post by resting on a floor, concrete, or ground near the caddy shack. It can also be used at golf ranges where golfers dirty their clubs in practice.

My invention provides a golf club washer that self-cleans all sizes of club heads with no moving parts to wear or replace. It has easy, quick maintenance features. It has a visible space on top for sponser advertisement. My invention is needed by golfers because there are very few in use. Prior art club washers failed in marketing due to golf course owners reluctance to accept complicated maintenance problems, and because the washers lacked advertising space, and because they limited the clubs to irons only. My invention corrects these failures and will assure widespread distribution for the betterment of golfers everywhere.

The scope of my invention should be determined by the appended claims and their legal equivalents rather than by the examples given,

I claim:

1. A golf club cleaning device for cleaning golf clubs, said device comprising:

an elongated tub having opposing side walls, a front wall, a rear wall, a bottom wall and an open top, said walls joined together to define a sump for holding a cleaning liquid, said front end wall being sloped at an angle to said bottom wall and having an opening therein, each side wall having a drain hole therethrough communicating with said sump, a pair of flanges extend outwardly from said rear wall to define a U-shaped channel, said channel adapted to engage a square post;

first, second and third brushes, each brush comprised of a base with a plurality of bristles extending therefrom, each base having a pair of slotted openings therein, said first brush mounted to said bottom wall and said second and third brushes mounted to a respective side wall;

an elongated lid removably connected to said top of said tub, said lid having an elongated groove therein opening at a first end of said lid, said lid opening in alignment with said tub opening and said lid having a slot at a second end thereof in alignment with said channel, said openings and said groove allowing club entry into said tub for engagement with said brushes;

a lockplate detachably connected to said lid by a pair of bolts and a pair of cotter pins, said lockplate and said second end of said lid together forming means for locking said device to said post.

2. A device as claimed in claim 1, wherein said tub, lid and lockplate are composed of soft, heavy-duty plastic material.

3. A device as claimed in claim 1, wherein said brushes are composed of soft plastic material.

4. A device as claimed in claim 1, wherein the tub defines two pair of spaced brush locks for mounting said brushes in said tub.

5. A device as claim in claim 1, wherein the tub defines a plurality of lips that interlock with a corresponding plurality of lips on said lid when the lid is attached with said tub.

* * * * *